US005444475A

United States Patent [19]

Mitani

[11] Patent Number: 5,444,475

[45] Date of Patent: Aug. 22, 1995

[54] THERMAL RECORDING HEAD

[75] Inventor: Masao Mitani, Katsuta, Japan

[73] Assignee: Hitachi Koki Co., Ltd., Tokyo, Japan

[21] Appl. No.: 85,880

[22] Filed: Jul. 6, 1993

[30] Foreign Application Priority Data

| | | | |
|---|---|---|---|
| Jul. 3, 1992 | [JP] | Japan | 4-176732 |
| Jul. 17, 1992 | [JP] | Japan | 4-190754 |
| Dec. 25, 1992 | [JP] | Japan | 4-347154 |
| Mar. 26, 1993 | [JP] | Japan | 5-068258 |

[51] Int. Cl.[6] ..... B41J 2/335; B41J 2/345

[52] U.S. Cl. ..... 347/200; 347/202; 347/204; 347/205

[58] Field of Search ..... 346/76 PH; 347/200, 347/202, 204, 205

[56] References Cited

U.S. PATENT DOCUMENTS

| | | | |
|---|---|---|---|
| 4,680,593 | 7/1987 | Takeno et al. | 346/76 PH |
| 4,868,584 | 9/1989 | Nikaido et al. | 346/76 PH |

FOREIGN PATENT DOCUMENTS

| | | |
|---|---|---|
| 0164876 | 12/1981 | Japan . |
| 0061582 | 4/1982 | Japan . |
| 0012357 | 1/1986 | Japan . |
| 0290067 | 12/1986 | Japan . |

*Primary Examiner*—Huan H. Tran

*Attorney, Agent, or Firm*—Sughrue, Mion, Zinn, Macpeak & Seas

[57] ABSTRACT

A thin-film thermal recording head, used in a facsimile machine or a thermal printer, including heat resistors formed from only a Cr—Si—SiO or Ta—Si—SiO alloy thin-film resistor layer and a chromium, molybdenum, nickel, or tungsten thin-film conductor layer. The heat resistor is formed on a substrate having a linear thermal expansion coefficient from room temperature to 300° C. of $5\times10^{-8}$/°C. or less. The heat resistor is also described having a thin anti- abrasion layer with thickness of 0.5 μm or less. The thin-film thermal recording head is also described in monolithic form with a portion of the heat resistor formed to directly contact an output electrode of a drive LSI circuit. In this case, a double-layer thermal-insulation layer can be formed between the substrate and the portion of the heat resistor that contacts and heats heat-sensitive recording paper. The two layers of the thermal-insulation layer are formed from a heat-resistant resin and an inorganic insulator.

2 Claims, 9 Drawing Sheets

X-X CROSS-SECTION

THERMAL RECORDING HEAD

BACKGROUND OF THE INVENTION

1. Field of the Invention

The present invention relates to a thermal recording head and more particularly to a thermal recording head wherein protective layers are eliminated from heat resistors used in the thermal recording head.

2. Description of the Related Art

Thin-film thermal recording heads are an important component for thermal recording and thermal transcribing in such recording devices as facsimile machines and printers. The basic structure of a conventional thermal recording head is shown in FIG. 1. A substrate 1 is provided to a ceramic substrate (not shown). To the substrate 1 is provided a 500 to 1,000 Å thick heat resistor layer 2. A barrier layer 3 is provided to the heat resistor layer 2 so as not to cover the portion of the heat resistor layer 2 for heating heat-sensitive recording paper. A thin-film conductor 4 is formed on the barrier layer 3 a distance away from the heating portion of the resistor. The conductor 4, the portion of the barrier layer 3 not covered by the conductor 4, and the heating portion are covered by an anti-corrosion layer 5. The anti-corrosion layer 5 is covered with an anti-abrasion layer 6.

The substrate 1 is a glass layer several 10s of μm thick that is sufficiently smooth to allow formation of the heat resistor layer 2 thereon. The substrate 1 must thermally insulate the heat resistor layer 2 from the ceramic substrate, so that as much of the thermal pulse generated by the heat resistor 7 as possible is transferred toward the anti-corrosion layer 5 and the anti-abrasion layer 6. The substrate 1 must also cool the heat resistor layer 2 between heat pulses by transferring heat away from the heat resistor layer 2.

The temperature of the heat resistor layer 2 rises from an original temperature to between 250° to 300° C. during each 2 ms pulse voltage. Its temperature must cool to the original temperature during the subsequent 20 ms or so inter-pulse interval. A heat resistor for a thermal recording head must be durable enough to repeat this harsh cycle 100 million times without its rate of change of resistance exceeding + or −10%. Heat resistor materials should have resistivity between 1,000 to 2,000 μΩcm because the practical range for thin-film thickness is between 500 to 1,000 Å. Only a few conventional materials, such as $Ta_2N$, TiOx, and $B_2Hf$, successfully meet these requirements. Because all of these materials oxidize when heated in air, and burn out as a result, the anti-oxidation layer 5 is indispensable in conventional thermal recording heads as a layer for blocking oxygen from contacting the heat resistor layer 2. The anti-corrosion film 5 is generally a 3 to 5 μm layer of $SiO_2$ formed by sputtering. However, because the $SiO_2$ layer is easily abraded by contact with the heat-sensitive recording paper, its surface must be covered with the anti-abrasion layer 6. The anti-abrasion layer 6 is usually a 2 to 3 μm layer of $Ta_2O_5$ formed by sputtering. The anti-oxidation layer 5 and anti-abrasion layer 6 also protect the thin-film conductor 4, which is usually formed from a soft metal such as aluminum, from abrasion.

If the thin-film conductor 4 were formed directly on the thin-film heat resistor layer 2, applying a voltage to the thin-film conductor 4 would generate electromigration in the heat resistor layer 2. Such electromigration greatly changes the resistance of the heat resistor layer 2. The barrier layer 3 insulates the heat resistor layer 2 from the conductor 4, thereby preventing electromigration. The barrier layer 3 is a thin-film layer, about 500 to 1,000 Å thick, formed from a material with a high melting point, such as chromium.

The metal conductor 4 is 1 to 2 μm thick to reduce its resistance. This thickness raises the surface level of the conductor 4 above that of the heating portion, creating a "hill and valley" situation, with the heating portion in the valley. The conductor 4 is usually formed at a position about 200 to 300 μm away from the heating portion so the heat-resistant recording paper can contact the heating portion without being obstructed by the conductor 4. Positioning the conductor 4 a distance from the heating portion also minimizes heat loss to the conductor 4 which conducts heat better than the protective layers. Separating the conductor 4 and the heating portion by this distance allows lowering the resistance of the barrier layer 3 to about 1% that of the thin-film resistor layer 2. Heat loss can thus be suppressed.

Research fueled by the continuing demand for faster printing speeds has produced thermal printers, including thermal recording heads formed as described above, which can print with 1 ms heat pulse at frequencies of 100 Hz. However, to attain such high speeds, the heat resistor must be heated to high temperatures that create great thermal and mechanical distortion in nearby components. The warping can cause cracks in the anti-corrosion layer 5 and the anti-abrasion layer 6. These cracks can allow air to contact the thin-film resistor layer 2 which can burn out as a result.

High-speed facsimile machines and other products have been produced with thin-film heat resistors formed from oxidized materials, that is, materials stabilized by heat processes performed in air. For example, Japanese Patent Application Kokai No. SHO-58-84401 describes a thin-film heat resistor made from a Cr—Si—SiO alloy material and Japanese Patent Application Kokai No. SHO-57-61582 describes a thin-film heat resistor made from a Ta—Si—SiO alloy. These materials are extremely stable when heated in an oxidation atmosphere as long as the temperature is equal to or less than that of the heat processes.

An LSI circuit provided to thermal recording heads for energizing the heat resistor 7 with a voltage pulse is conventionally connected to the heat resistor 7 as shown in FIG. 2. A wiring substrate 8 is mounted adjacent to the substrate 1 on a heatsink 9. To the end of the wiring substrate 8 opposing the substrate 1 is connected a connector 10. The heat resistor 7 is mounted on the substrate 1. A drive LSI circuit 11 is connected to the wiring substrate 8 by a gold wire 12 and to the substrate 1 by a gold wire 12'. A resin 13 covers the gold wires 12 and 12' and the drive LSI circuit 11 for protection.

A problem has been known with commercially produced high-speed thermal recorders with the basic structure shown in FIG. 1 in that the anti-oxidation layer 5 and the anti-abrasion layer 6, totaling 5 to 8 μm, prevent the heating portion of the heat resistor layer 2 from contacting the heat-sensitive recording paper directly. Also, almost half of the energy required for recording with conventional thermal recording heads serves to heat the protective layers instead of the heat-sensitive paper. Furthermore, the protective layers thermally buffer the heat-sensitive recording paper from the heat resistor layer, creating a delay from when the heat resistor heats to when the surface of the protective layers contacting the heat-sensitive recording paper heats. Further a great deal of heat that the heat resistor generates escapes to the substrate because of the undesirable thermal insulating properties of the protective layers.

There has also been known a problem with the method of connecting the LSI circuit 11 with the heat resistor 7 shown in FIG. 2 in that more connections by gold wires 12 and 12' are required than the number of heat resistors 7. Because so many gold wire connections are required, the cost of the gold wire accounts for one third the entire cost to produce the thermal recording head. This configuration also limits further decreases in size of the thermal recording head.

SUMMARY OF THE INVENTION

It is therefore, an object of the present invention to overcome the above-described drawbacks, and to provide a thermal recording head wherein energy required for energizing heat resistors is reduced.

Another object of the present invention is to provide a thermal recording head wherein heat generated for performing thermal recording is prevented from being leaked toward a substrate side.

Still another object of the present invention is to provide a thermal recording head wherein manufacturing steps can be greatly reduced.

Yet another object of the present invention is to provide a thermal recording head which is compact in size and is capable of performing a high speed of printing.

The above and other objects of the present invention can be achieved by a thermal recording head for thermally recording an image on a heat-sensitive recording medium, which comprises a thin-film resistor layer and a support. The thin-film resistor layer has a heating portion for forming direct abutment contact with the heat-sensitive recording medium. The thin-film resistor layer is energized with pulsed electric current. The heating portion heats in pulses according to the pulsed electric current for heating the heat-sensitive recording medium and forms an image thereon. The support is provided for supporting the thin-film resistor layer. The support is made from a material with a lower linear thermal expansion coefficient than the linear thermal expansion coefficient of the thin-film resistor layer material. The thin-film resistor layer is a thin-film layer that is 500 to 1,000 Å thick and made from either a Cr—Si—SiO alloy or a Ta—Si—SiO alloy. The support material has a linear thermal expansion coefficient of less than $5\times10^{-6}$/°C. from 20° to 300° C.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Preferred embodiments of the present invention will be described while referring to the accompanying drawings.

Figure 3:
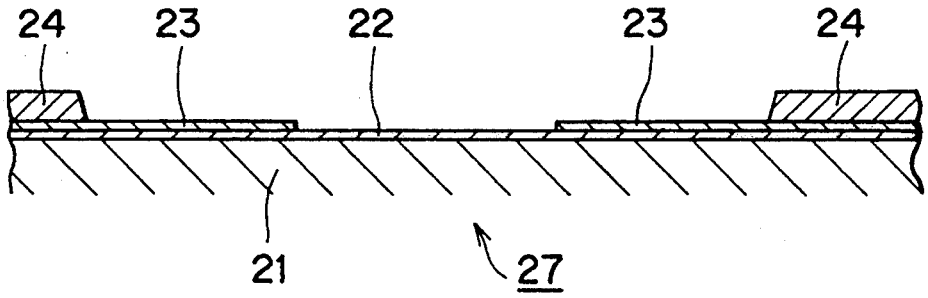
FIG. 3 is a cross-sectional view showing an arrangement of a heat resistor according to first through third embodiment of the present invention.

The present inventor produced a thermal recording head including heat resistors 27 formed according to a first preferred embodiment of the present invention. A predetermined number of heat resistors 27 are juxtaposed in a direction perpendicular to the sheet of drawing. As shown in FIG. 3, each heat resistor 27 includes a Cr—Si—SiO alloy thin-film resistor layer 22 formed on a substrate 21, a chromium thin-film layer (hereinafter referred to as "first thin-film conductor") 23, and a nickel thin-film conductor (hereinafter referred to as "second thin-film conductor layer") 24. The portion of the heat resistor 27 which contacts and heats the heat-sensitive paper is formed entirely by the Cr—Si—SiO alloy thin-film resistor layer 22.

In the first preferred embodiment, the substrate 21 is formed from silicon and has a linear thermal expansion coefficient of about $3\times10^{-6}$°/C. from room temperature to 300° C. The substrate 21 may be made from such a material as Neo seram produced by Nippon Electric Glass Co., Ltd., Pyrex glass (trademark) or a mullite ceramic. The Cr—Si—SiO alloy thin-film resistor layer 22 is formed about 700 Å thick, although any thickness between and including 500 to 1,000 Å is acceptable. The first thin-film conductor 23 is formed about 1,000 Å thick, although any thickness between and including 500 to 1,000 Å is acceptable. The second thin-film conductor 24 is about 2 μm thick. The heat resistor 27 has a resistance of about 2.5 kΩ. The first thin-film conductor 23 can be replaced with a thin film made from such hard metals with high melting points and low resistances as molybdenum, tungsten, and tantalum. Further, the second thin-film conductor 24 can be formed shorter and the first thin-film conductor 23 used as a conductor. This would reduce the number of manufacturing processes and reduce the cost of the head.

Because the thin-film resistor layer 22 is attached directly to the substrate 21, the substrate 21 heats with the heat pulse of the thin-film resistor layer 22. Therefore, both the substrate 21 and the thin-film resistor layer 22 expand with each pulse of heat. The thin-film resistor layer 22 will crack if the substrate 21 expands to a greater extent than does the thin-film resistor layer 22.

Figure 1:
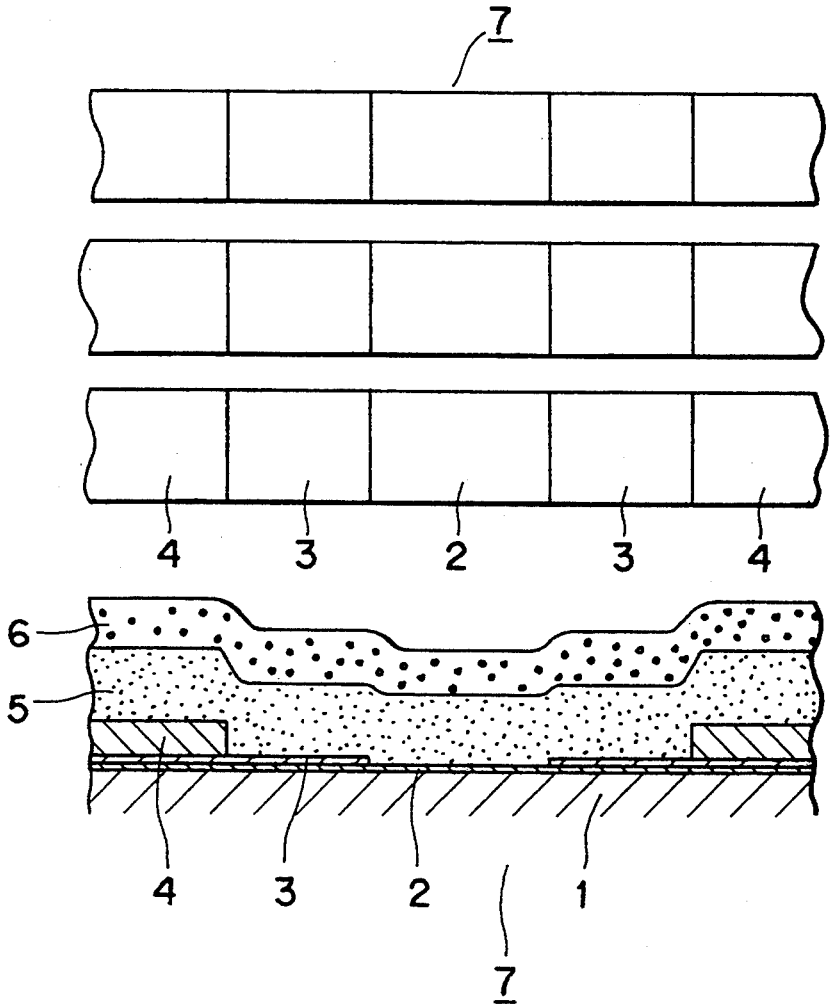
FIG. 1 PRIOR ART
FIG. 1 includes a plan view and a cross-sectional view showing a conventional heat resistor.
Figure 2:
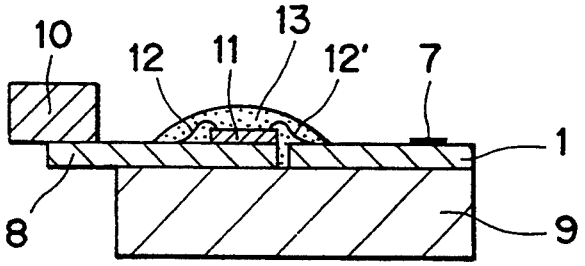
FIG. 2 PRIOR ART
FIG. 2 is a cross-sectional view showing a conventional thermal print head.

Although the glazed-ceramic substrates of conventional heat resisters have large linear thermal expansion coefficients of about $9\times10^{-6}$°/C., the protective layers, that is, the $SiO_2$ anti-oxidation layer 5 and the $Ta_2O_5$ anti-abrasion layer 6 shown in FIG. 1 have small linear thermal expansion coefficients of about $1\times10^{-6}$ and less and therefore constantly apply compressed stress to the thin-film resistor layer 2, preventing it from cracking.

Because no such protective layers are present in the depicted embodiment, using a glazed-ceramic substrate would cause cracking of the Cr—Si—SiO alloy thin-film resistor layer 22 and shorten the life of the heat resistor 27. However, because the average linear thermal expansion coefficient of the substrate 21 in the depicted embodiment is about $3\times10-6$°/C. from room temperature to 300° C., the substrate 21 expands less than the thin-film resistor layer 22. In this way the substrate 21 applies compressed stress to the thin-film resistor layer 22, preventing cracks. To the silicon substrate 21 is formed a 5 μm thick $SiO_2$ layer.

The present inventor performed evaluation tests on the thermal recording head including heat resistors having the above described structure by applying a voltage to the thermal recording head to record images on heat-sensitive recording paper. The thermal recording head according to the first embodiment required only about half the energy per dot required by a conventional thermal recording head to recording images of equal quality. That is, at a pulse width of 1 ms and an inter-pulse interval (cooling period) of 10 ms, a conventional thermal recording head requires about 0.34 W/dot whereas the thermal recording head according to the present invention required only 0.18 W/dot. On the other hand, the reduction in cooling time, derived from the excellent cooling characteristic of the silicon substrate, and in applied energy allow a recording speed double that of conventional thermal recording heads. That is, at a recording energy of 0.35 W/dot, this thermal recording head achieved a pulse width of 0.5 ms and a frequency of 5 ms. The present inventor tested the life of the heat resistor according to the depicted embodiment by performing continuous recording with this thermal recording head and found each heat resistor successfully generated 100 million pulses.

A heat resistor 27 according to a second preferred embodiment of the preferred embodiment has the same structure and effects as those of the heat resistor 27 in the first preferred embodiment, but differs in the material of the substrate 21. The present inventor produced three thermal recording heads according to the second preferred embodiment, each with different materials for the substrate: silica glass, borosilicate glass (Pyrex, trademark), and low alkali glass produced by Nippon Electric Glass, Co., Ltd. Between 30° to 300° C., the average linear thermal expansion of silica glass is $0.4\times10^{-6}$, of borosilicate glass (Pyrex, trademark) is $3.3\times10^{-6}$, and of low alkali glass is $5.0\times10^{-6}$. The present inventor performed recording tests on the thermal recording heads by consecutively applying a 0.32 W/dot 0.5 ms pulse to the heat resistors at a 5 ms inter-pulse interval. Although all the thermal recording heads endured the test sufficiently for being used in actual applications, the life of the low alkali glass was slightly shorter than that of the others. From these results it can be assumed that using a substrate with linear thermal expansion coefficient of $5\times10^{-6}$°/C. or less in combination with the Cr—Si—SiO alloy thin-film material produces a heat resistor with life sufficient for practical application.

A thermal recording head according to a third preferred embodiment of the present invention has heat resistors with the same structure as those in thermal recording heads according to the first and second preferred embodiments, but employs a Ta—Si—SiO alloy thin-film heat resistor layer instead of the Cr—Si—SiO alloy thin-film heat resister layer. The present inventor produced a thermal recording head according to the third preferred embodiment and performed recording tests on it to determine its life. The results of these tests were exactly the same as those of the thermal recording heads according to the first and second preferred embodiments, showing that these two types of thin-film resistors share similar qualities.

A particularly severe section of the continuous recording life tests involves introducing grit between the thermal recording head and the heat-sensitive recording paper during tests. This test attempts to replicate a situation where dust and dirt collects between the thermal recording head and the heat-sensitive recording paper, for example, after filtering through windows of an office in an arid region, causing the heat resistor to crack from great mechanical warping. During these tests the resistance value of the heat resistor layer would sometimes deviate from the prescribed range after about 10 million pulses, showing that reliability can be undesirably affected by the ambient environment. The fourth preferred embodiment is a measure to counter this problem.

Figure 4:
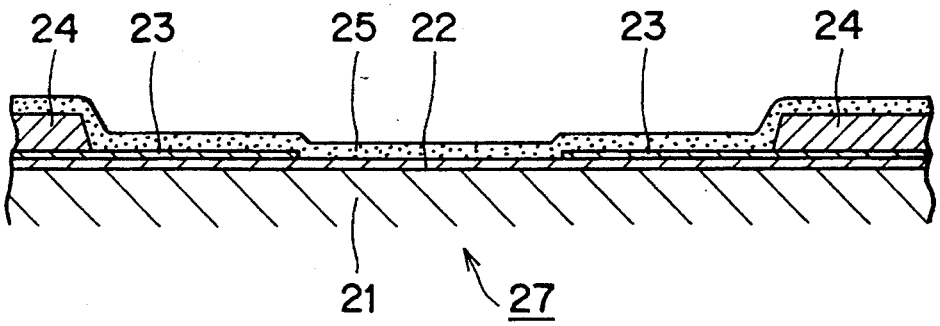
FIG. 4 is a cross-sectional view showing a heat resistor according to a fourth embodiment of the present invention.

As shown in FIG. 4, in this preferred embodiment an extremely thin anti-abrasion protective layer 25 is formed to the heat resistor. The anti-abrasion protective layer 25 is formed from a coating of $Ta_2O_5$ or SiN. $Ta_2O_5$ or SiN were chosen for their excellent resistance to abrasion. The protective layer 25 need only protect the 500 to 1,000 Å thick thin-film resistor 22 and the first thin-film conductor 23 from abrasion by grit. Therefore, the present inventor considered the anti-abrasion quality of $Ta_2O_5$ and presumed thickness in the range of 0.1 to 0.5 μm would be sufficient. To test this assumption, the present inventor produced thermal recording heads each with heat resistors having $Ta_2O_5$ protective layers 5 of different thickness, i.e., 0.1, 0.2, and 0.4 μm, and tested the life of each by introducing grit during recording as previously described. Each type of heat resistor successfully generated 30 to 50 million pulses. Adding a protection layer with thickness in the range of 0.1 to 0.5 μm to the heat resistor increased energy consumption only by 10% or less over a protective-layerless heat resistor.

The present inventor performed tests to show the influence of the protective layer 25 and the substrate 21 on the anti-pulse characteristic of the Cr—Si—SiO alloy thin-film resistor 22. The results of these tests are also shown in Table 1.

TABLE 1

| No. | Substrate | Preventative Layer (Thickness in μm) | Average Thermal expansion coefficient* | Anti-pulse Tolerance |
|---|---|---|---|---|
| 1 | Glazed | None | 6.5** | 1.23 |

TABLE 1-continued

| No. | Substrate | Preventative Layer (Thickness in μm) | Average Thermal expansion coefficient* | Anti-pulse Tolerance |
|---|---|---|---|---|
| 2 | Aluminum Glazed Aluminum | $SiO_2$(3.0)/ $Si_3N_4$(1.0) | 3.6** | 1.25 |
| 3 | Neo seram N-11 | $Si_3N_4$(0.3) | 1.8** | 1.69 |
| 4 | Neo seram N-11 | None | 0.6** | 1.77 |

*From room temperature to 300° C.
**× $10^{-6}$/°C.

As shown in Table 1 above, the present inventor produced four thermal recording heads Nos. 1, 2, 3, and 4. The materials, shapes, and production methods for the thin-film resistor 22, the first thin-film conductor 23 and the second thin-film conductor 24 are all the same as described above. That is, thermal recording head No. 1 was produced with protective-layerless heat resistors formed on a glazed aluminum substrate. Thermal recording head No. 2 was produced with conventional heat resistors that were formed on a glazed aluminum substrate and that included an approximately 3.0 μm thick anti-corrosion layer 15 formed by sputtering and on top of this an approximately 1 μm thick $Si_3N_4$ anti-abrasion layer 16 also formed by sputtering (see FIG. 1). Thermal recording head No. 3 was produced with heat resistor that were formed on a Neo seram N-11 produced by Nippon Electric Glass Co., Ltd. substrate and that included an extremely thin protective layer 25 formed from a 0.3 μm thick $Si_3N_4$ layer formed by chemical vapor deposition. Thermal recording head No. 4 was produced with protective-layerless heat resistors formed on a Neo seram N-11 substrate.

On the substrate 21 is formed an approximately 700 Å thick, 100 μm wide, (200 dots/inch) 150 μm long Cr—Si—SiO alloy thin-film resistor 22 with resistance of about 2,500 Ω. To the Cr—Si—SiO alloy thin-film resistor 22 is formed an approximately 500 Å first thin-film conductor 23 so as to leave exposed a heating portion of the thin-film resistor 22. An approximately 2 μm thick aluminum conductor 24 is formed to the first thin-film conductor 23 so as to leave about 300 μm of the barrier metal thin film 3 exposed.

Each tested material listed in Table 1 has a linear thermal expansion coefficient in the temperature range from room temperature to 300° C. as shown below in Table 2.

TABLE 2

| Material | Linear thermal expansion coefficient* |
|---|---|
| Glazed Aluminum | 6.5** |
| Pyrex Glass (Trademark) | 3.5** |
| Silicon | 3.1** |
| $Si_3N_4$ | 3.0** |
| $Ta_2O_8$ | 0.8** |
| $SiO_2$ | 0.6** |
| Neo seram N-11 | 0.6** |

*From room temperature to 300° C.
**× $10^{-6}$/°C.

The average linear thermal expansion coefficients shown in Table 1 for thermal recording heads No. 1 and 4 (no protective layer) are the linear thermal expansion coefficient of the substrate and for thermal recording heads No. 2 and 3 (protective layer) the arithmetic mean of the linear thermal expansion coefficients of the protective layer and the substrate. An explanation of these numeric values will be supplied later. Cracking of the thin-film resistor caused by mechanical fatigue is affected by the magnitude of repeated thermal stress applied to the substrate and the protective layer with each pulse of heat. The magnitude is proportional to the arithmetic mean produced from the linear thermal expansion coefficients of the protective layer and the substrate between room temperature and 300° or 400° C.

Figure 11:
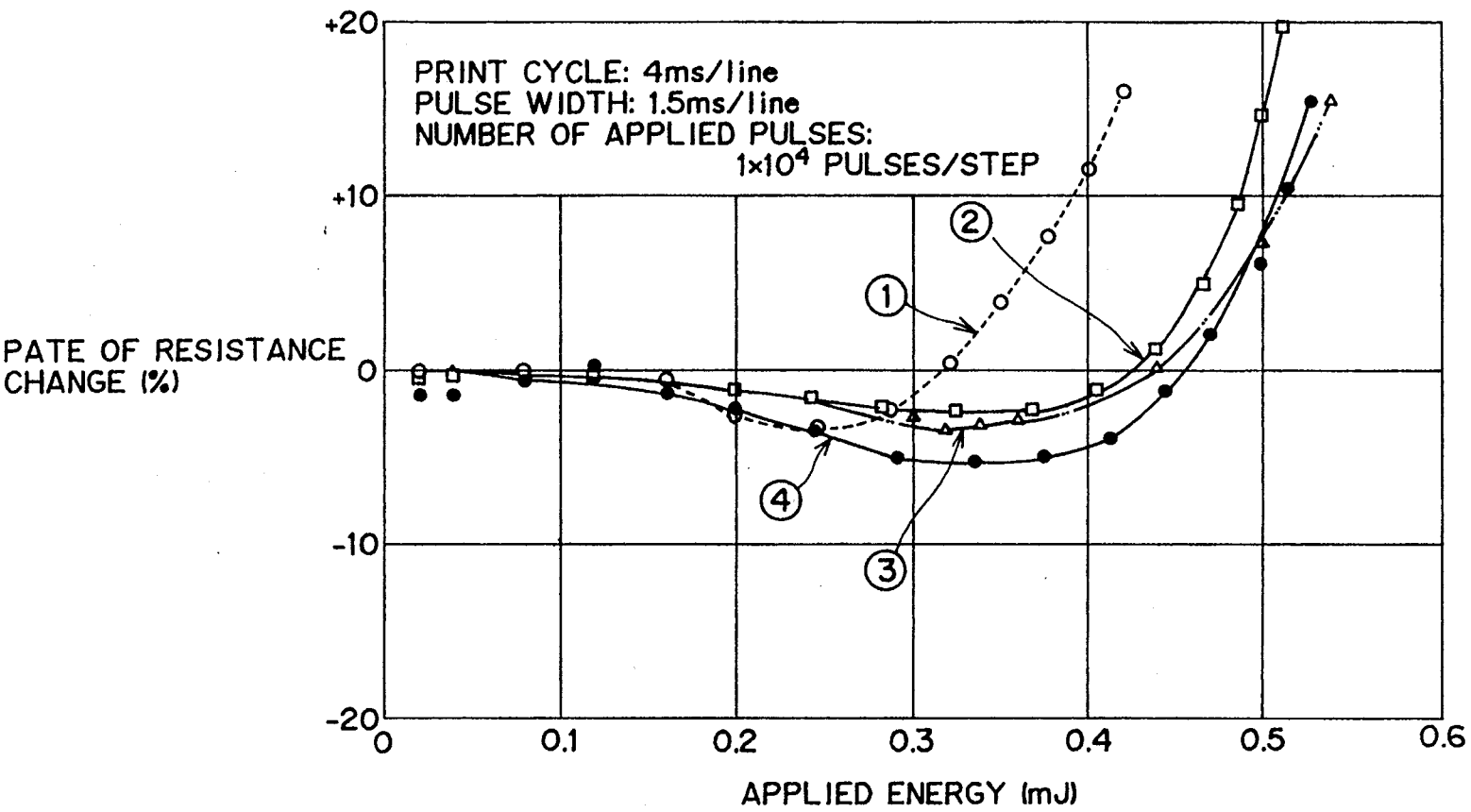
FIG. 11 is a graphical representation showing a SST characteristic.

The present inventor produced the four types of heat resistors listed as No. 1 through 4 in Table 1 and performed step-up stress tests (SST) on each. An example of the results of these tests are shown in FIG. 11. The applied energy value where each step-up stress test characteristic crosses the lateral axis (0% rate of resistance change) as shown in FIG. 11 can be considered the value that represents the anti-pulse characteristic of the heat resistor.

On the other hand, the Cr—Si—SiO alloy thin-film resistor 22 does not crack simply from heating. Consequently, although cracking is generally considered to be caused by fatigue failure from repeated mechanical load, it is not fatigue failure from thermal expansion and contraction of the extremely thin, for example, 0.07 μm, resistor thin film itself. Rather it is probably influenced by simultaneous heating and cooling of the substrate or the thermal expansion and contraction of the protective layers.

Figure 12:
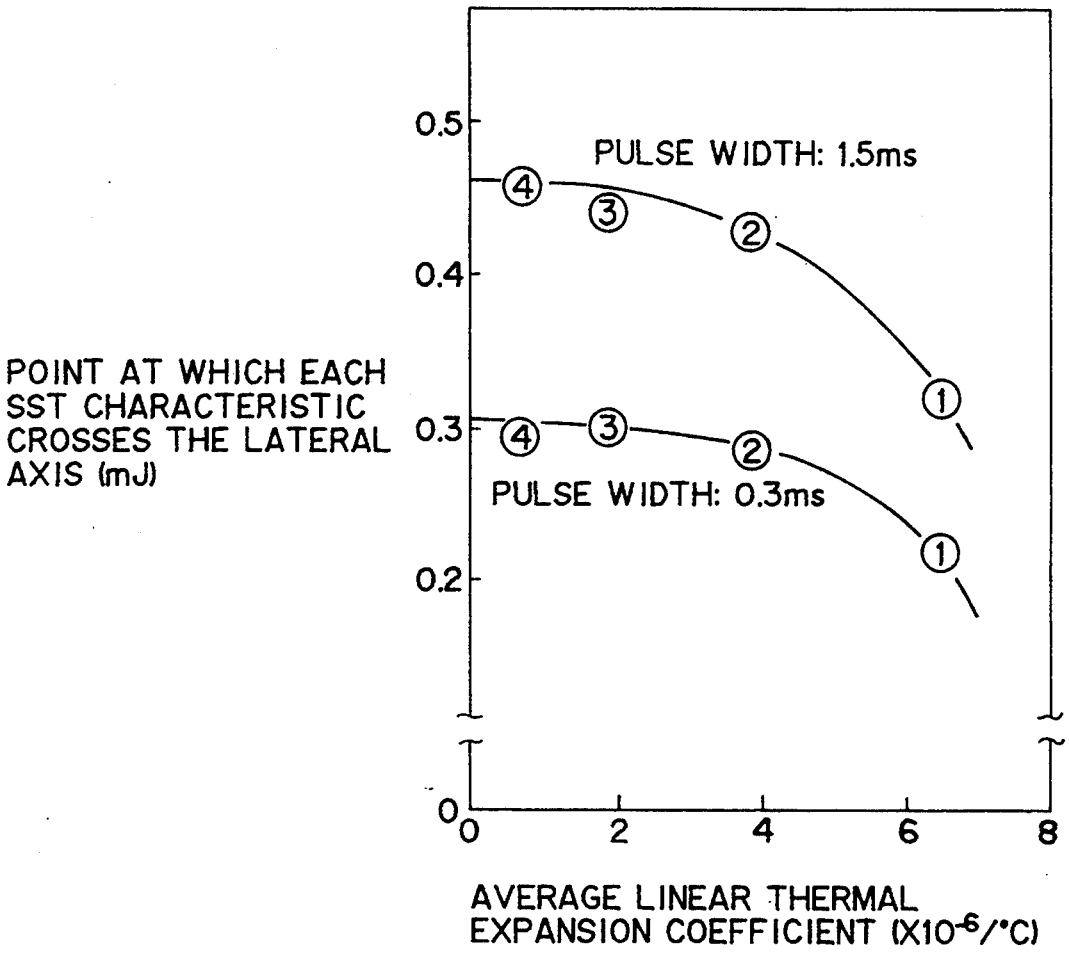
FIG. 12 is a graphical representation showing a relationship between a thermal stress and anti-pulse characteristic.

To confirm this assumption, the present inventor plotted the graph in FIG. 12, showing how the average linear thermal expansion coefficients (shown in Table 1) affect the anti-pulse characteristics (point at which each step-up stress test characteristic crosses the lateral axis in FIG. 11). Plotted in FIG. 12 with the anti-pulse characteristic shown in FIG. 11 for an applied pulse width of 1.5, is also plotted the anti-pulse characteristic for a shorter applied pulse width of 0.3 ms. The inter-pulse interval used in both cases was 10 ms. That is, the energy applied per unit of time was the same for both pulse widths. The conditions for rise in temperature of the substrate were also set.

As is clearly shown in FIG. 12, the anti-pulse characteristic of the heat resistor is determined by the above mentioned average linear thermal expansion coefficient and is basically unrelated to the presence or absence of protective layers.

On the other hand, by comparing the recording heat efficiency by the existence or absence of protective layers in the case of a 1.0 ms wide pulse, it could be measured that thermal recording head No. 2 (see Table 1), which is presently used in heat-sensitive facsimile equipment, requires a 0.34 mJ/dot applied energy. The 0.26 mJ/dot applied energy necessary for the other thermal recording heads (Nos. 1, 3, and 4) reveals a 25% in energy requirement under the same conditions. The reason the amount of the necessary applied energy is comparatively small for thermal recording head Nos. 1, 3, and 4 is that the conventional 2 μm thick $Ta_2O_5$ anti-abrasion layer 6, which has a small heat transmission rate, used in thermal recording head No. 2 was exchanged for a 1 μm thick $Si_3N_4$ layer, which has a large heat transmission rate.

Next, the life of heat resistors will be explained. It is well known that the ratio of the anti-pulse characteristic (point where the step-up stress test characteristic crosses the lateral axis in FIG. 11) to the necessary applied energy is related to recording life. The present inventor termed this ratio the anti-pulse tolerance and noted the values in Table 1. It was surprising to observe that the two thick protective layers considered indispensable up to now might be unnecessary even when using a glazed ceramic substrate. The present inventor performed continuous mock recording tests on the four sample thermal recording heads to test their lives. The results of these tests appear in FIG. 13. No heat-sensitive paper is used in mock recording tests. Each thermal recording head was tested under the same conditions. That is, an applied pulse width of 0.46 ms, that is, only one half a standard pulse width, and an applied energy of 0.25 mJ/dot, which is equivalent to the applied energy required for a protective-layerless thermal recording head.

Mock recording tests are simple and easy to perform but several points should be taken into consideration when reviewing results of these tests. For example, mock recording tests do not take into consideration breaks in the heat resistor caused by cracking and scratches in the heat resistor caused by dust and dirt caught between the thermal recording head and the heat-sensitive paper. Also, mock recording tests are actually harsher on a thermal recording head than actual recording because during actual recording the heat-sensitive paper absorbs heat from the heat resistors and cools them. However, these test are especially severe on a thermal recording head with protection-layerless heat resistors because this type of thermal recording head derives greater benefit from the above cooling effects of the heat-sensitive paper than does a thermal recording head with protective layers. Further, a thermal recording head including heat resistors with thin preventative layers derives more cooling effect from the heat-sensitive paper than does a thermal recording head including heat resistors with thick protective layers.

Figure 13:
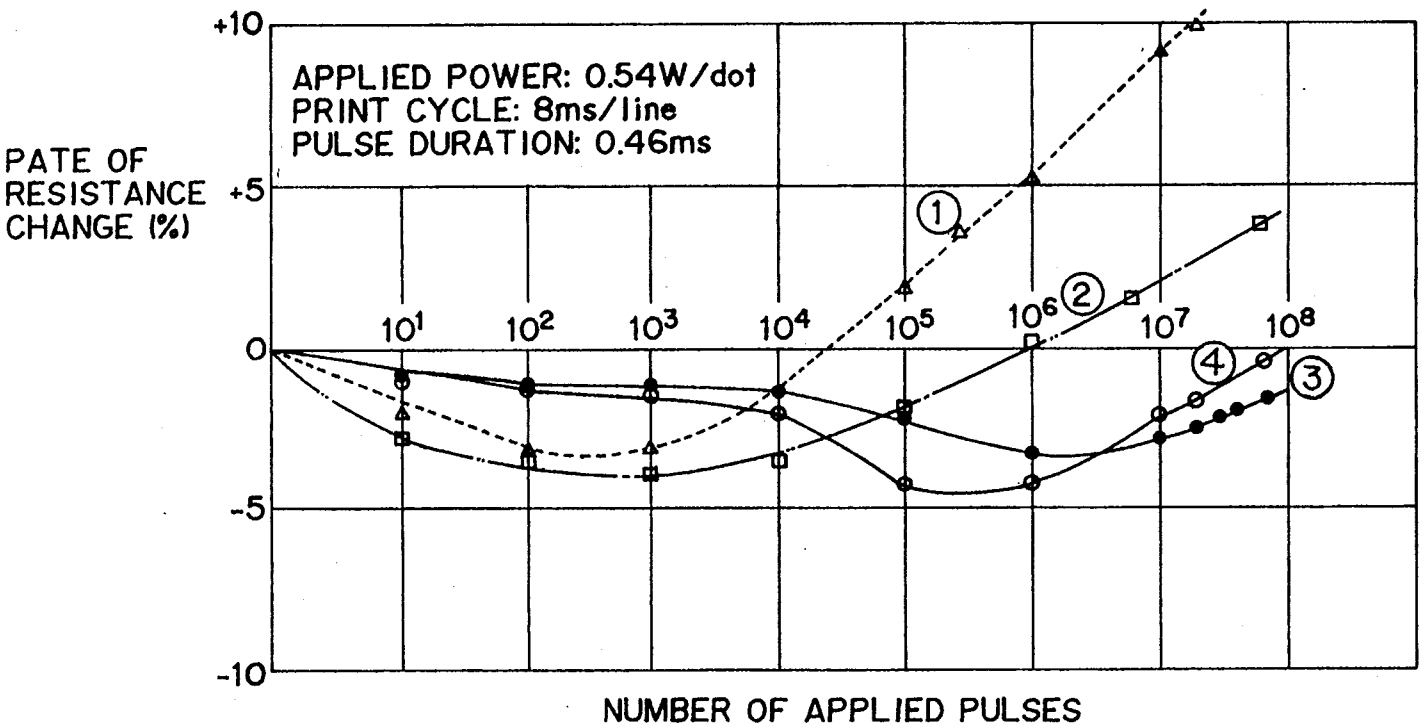
FIG. 13 is a graphical representation showing a mock recording characteristic.

Taking these points into consideration it can be understood why the results shown in FIG. 13 show a mock recording life for sample No. 4, which has a large anti-pulse tolerance, shorter than for sample No. 3, which has a smaller anti-pulse tolerance. That is, the effective mass of heat resistor No. 3 becomes larger, even though its protective layer is thin, and therefore the temperature rise achieved by applying an equivalent amount of energy is smaller. However, it can be predicted that both thermal recording head Nos. 3 and 4 will attain the recording life of 10 billion to 100 billion pulses under standard recording conditions. However, since such a long recording life for the thermal recording head is unnecessary, the pulse can be shortened to an extremely short 0.1 ms or less without sacrificing a sufficient thermal head life. The effectiveness of the present invention can be understood by noting that when the pulse drive becomes this short, the protective layers, which slow the pulse time, must be reduced in thickness or eliminated. However, not simultaneously reducing the pulse inter-pulse interval will reduce the effects by half, so a concrete example of how to improve the cooling speed will be given in later embodiments of the present invention.

As shown in Table 1, the anti-pulse tolerance of thermal recording head No. 1 is equivalent to that of thermal recording head No. 2. Also, both thermal recording head Nos. 1 and 2 show the same anti-pulse characteristic during mock recording tests when applied with an energy of 0.34 mj/dot. Therefore, it would be expected that when applied with a pulse width of about 1 ms, a pulse width commonly used in thermal recording heads, both would show an equivalent life characteristic. However, as shown in FIG. 13 when a 0.46 ms pulse width or shorter is used, thermal recording head No. 1 shows a shortening of recording life. This shows that the linear thermal expansion coefficient of the substrate must be kept at $5\times10^{-6}$ or less when attempting to achieve a recording life specification of 50 million or more pulses when the applied pulse width is 0.5 ms. The present inventor confirmed these conclusions by actual recording life tests on the thermal recording heads No. 1, 3, and 4. The heat resistors in these thermal recording heads were shaped with the aluminum thin-film conductor 24 shifted by 2 mm so the heat-sensitive paper and the soft thin-film conductor 24 do not contact during recording. Even with the thin-film conductor 24 shifted so greatly away from the heat resistor 22, the resistance will only increase by 1% or less if the thickness of the first thin-film conductor 23 is slightly increased to 1,000 Å. When the wiring becomes long, the wire resistance can be regulated by welding the second thin-film conductor, for example, formed from an accumulation of aluminum or other metal, with the same metal or some similar method. On the other hand, conductor used in protective-layerless equipment must have sufficient resistance to corrosion and the like.

The following text will explain a heat resistor that optimally fulfills these requirements.

A hard, heat-resistance low resistance metal material such as nickel, chromium, molybdenum, tantalum, or tungsten can be used for the thin-film wiring conductor. Table 3 shows results of evaluation tests for determining the reliability of these metals as thin-film conductors and their applicability to production techniques (selective etching).

TABLE 3

| | Relative Resistance | Anti-corrosion Properties | Anti-abrasion Properties | Suitability to Selective Etching |
|---|---|---|---|---|
| Ni | Good | Good | Good | Good |
| Cr | Fair | Fair | Poor | Fair |
| Mo | Good | Fair | Fair | Fair |
| Ta | Fair | Fair | Good | Poor |
| W | Good | Fair | Fair | Fair |

When reviewing the results of galvanic corrosion tests it should be noted that the results do not necessarily indicate galvanic corrosion resistance of the tested thin-film conductors in the air because tests were performed under water. The poor abrasion resistance shown by chromium wire conductor makes it a risky choice as a conductor in a protective-layerless heat resistor in terms of long term reliability. However, chromium can be used as the conductor when a thin protective layer such as $Si_3N_4$ is formed on the Cr—Si—SiO alloy thin-film resistor. Also, like Cr—Si—SiO alloy thin-film resistor, tantalum thin film does not predispose well to wet etching unless in hydrofluoric acid etching liquid. Although tantalum thin film subjects well to dry etching, this degrades productivity.

Consequently, although all five metals listed above can be used for the thin-film conductor, nickel is the most suitable material because it is susceptible to high-speed sputtering, and therefore has good productivity, has a low resistivity, and is durable. A nickel thin-film is especially worth using because it can be applied by either electroplating or electroless plating. Nickel can also be applied by both wire bonding and soldering so is a convenient metalization.

The present inventor produced two thermal recording heads which included heat resistors formed on a Neo seram substrate. In one thermal recording head, the heat resistors had only two layers: a Cr—Si—SiO alloy thin-film resistor and an approximately 2,000 Å thick nickel thin-film conductor. The heat resistors in this thermal recording head resembles the one shown in FIG. 3 it has no aluminum second thin-film conductor 24 and its first thin-film conductor 23 is nickel instead of chromium. In the other thermal recording head, a 0.3 μm thick $Si_3N_4$ thin protective layer was formed to the Cr—Si—SiO alloy thin-film resistor and the approximately 2,000 Å thick nickel thin-film conductor. The present inventor performed step-up stress tests and mock recording tests on these thermal recording heads to determine the life of the respective heat resistors. These thermal recording heads showed characteristics almost the same as those of thermal recording head Nos. 3 and 4. Although both thermal recording heads showed satisfactory life in actual recording tests where grit was introduced between the thermal recording head and the heat-sensitive paper, a short in resistance was observed in the thermal recording head with protective-layerless heat resistors that was assumed to have resulted from a crack in the glass substrate.

The potion of the nickel thin-film conductor near the common electrode was nickel electroplated to about 2 μ thick to reduce resistance there. This portion was formed with the same materials and in the same way, although one side only, as the shifted electrode described above.

The present inventor performed recording tests to determine the life of these thermal recording heads when applied with an extremely short pulse with width of about 0.1 ms. The resistors with the approximately 0.3 μm thick $Si_3N_4$ protective layer successfully generated 50 million or more pulses. Even increasing the thickness of the protective layer to about 1 μm only slightly reduced the recording heat efficiency , that is by 5% or less. Regulating the thickness of the $Si_3N_4$ protective layer to about 1 μm in thermal recording heads that will be used in arid regions, where dust and sand are abundant in the air, can effectively increase the life of the heat resistors.

The size of a semiconductor-type thermal recording head, such as that described in U.S. Pat. No. 3,813,513, can be greatly reduced because its heat resistors and drive circuits formed on the same silicon substrate. However, in this semiconductor-type thermal recording head a diffusion layer is formed on the silicon substrate of the heat resistors so that thermally isolating the heat resistor from the silicon substrate is difficult and heat efficiency is poor. Japanese Patent Application Kokai SHO-54-130946 describes a thick glass layer formed to the silicon substrate and the thin-film resistor formed on the glass layer. Japanese Patent Application Kokai SHO-61-12357 describes producing a thermal recording head including heat resistors with a heat-insulation layer, formed from a double-layer structure including an organic material, formed on an aluminum substrate. The heat resistors of thermal recording heads described in Japanese Patent Application Kokai SHO-54-130946 and Japanese Patent Application Kokai SHO-61-12357 can both be formed using a silicon substrate. However, these ideas are difficult to put into practical application from a technical standpoint because both have formed on the silicon substrate a thick thermal-isolation layer, which is easily cracked by heat warping generated during its formation, and both contain a rapid gradient change between the thermal-isolation layer and the silicon substrate, which prevents formation of thin-film wiring.

Figure 5:
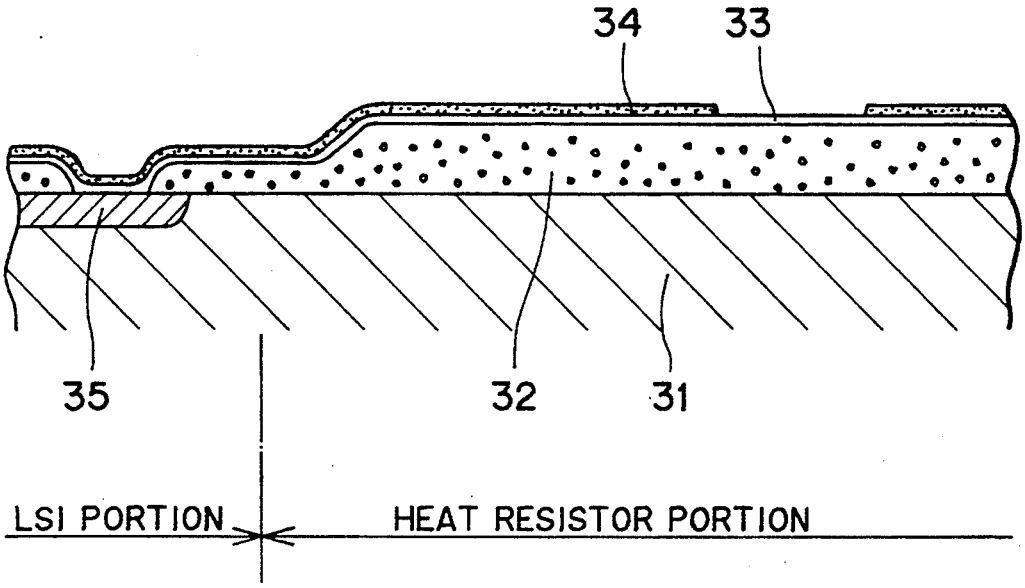
FIG. 5 is a cross-sectional view showing a thermal print head according to a fifth embodiment of the present invention.

FIG. 5 is a cross-sectional view showing the relationship between a heat resistor and a large-scale integrated (LSI) drive circuit in a thermal recording head according to a fifth embodiment of the present invention. An approximately 8 μm thick $SiO_2$ thermal insulation layer 32 is formed on a 0.35 mm thick silicon substrate 31 by chemical vapor deposition (CVD). Afterward, the $SiO_2$ layer is photoetched so that only the portion forming the heat resistor remains. The LSI drive circuit, the output terminal 35 of which can be seen in FIG. 5, is formed adjacent to the heat resistor portion using usual LSI manufacturing processes. Stepping process is performed to moderate the gradient between the $SiO_2$ layer and the output terminal 35. Next, a Cr—Si—SiO alloy thin-film resistor layer 33 and a thin-film conductor 34, formed from a metal, for example, chromium, with a high melting point, are formed successively by sputtering. Replacing the Cr—Si—SiO alloy thin-film heat resistor of the depicted embodiment with a Ta—Si—SiO alloy thin-film heat resistor obtains equivalent results. The silicon substrate 31 is photoetched into the shape desired for the heat resistor. The thin-film resistor 33 is 700 Å thick and the thin-film conductor 34 is 1,500 Å thick.

Figure 6:
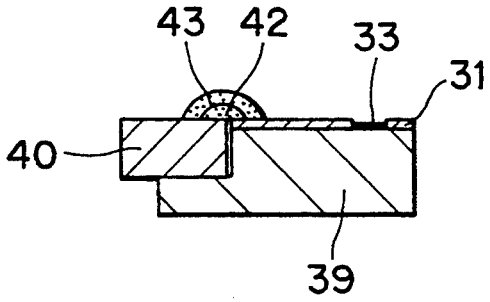
FIG. 6 is a cross-sectional view showing connection of the thermal print head according to the fifth embodiment of the present invention.

The present inventor incorporated, as shown in FIG. 6, a plurality of the above described integrated heat resistor/LSI drive circuit structures, mounted on the silicon substrate 31, into a 200 dot per inch (dpi) thermal recording head. The silicon substrate 31 was first die bonded onto a heatsink 39. The silicon substrate 31 was then electrically connected to a connector 40 attached to the heatsink 39. It should be noted that these can be connected by one wire bonding process, which uses gold wire 42, or one tape carrier process so that the number of connections equals the number of control signal lines or power source lines. Lastly, a resin layer 43 was applied to the gold wire 42.

The present inventor continuously recorded with the thermal recording head by applying to the heat resistors a 0.30 W/dot pulse with width of 0.5 ms at inter-pulse interval of 5 ms. The thermal recording head was capable of generating 100 million heat pulses per heat resistor. Even increasing the frequency to two times that of conventional thermal recording heads produced no tailing of the printed dot because of the good heat transmission characteristics and cooling effects of the silicon substrate 31. That is, a thermal recording head constructed according to the depicted embodiment can sufficiently increase the cooling speed of the substrate temperature even when the heat resistor is frequently heated. Additionally, halving the applied energy, as allowed by the greatly increased heat transmission efficiency of the protection-layerless thermal resistor layer, indicates that operation of the drive LSI is not affected by the heat flowing into the substrate.

Figure 7:
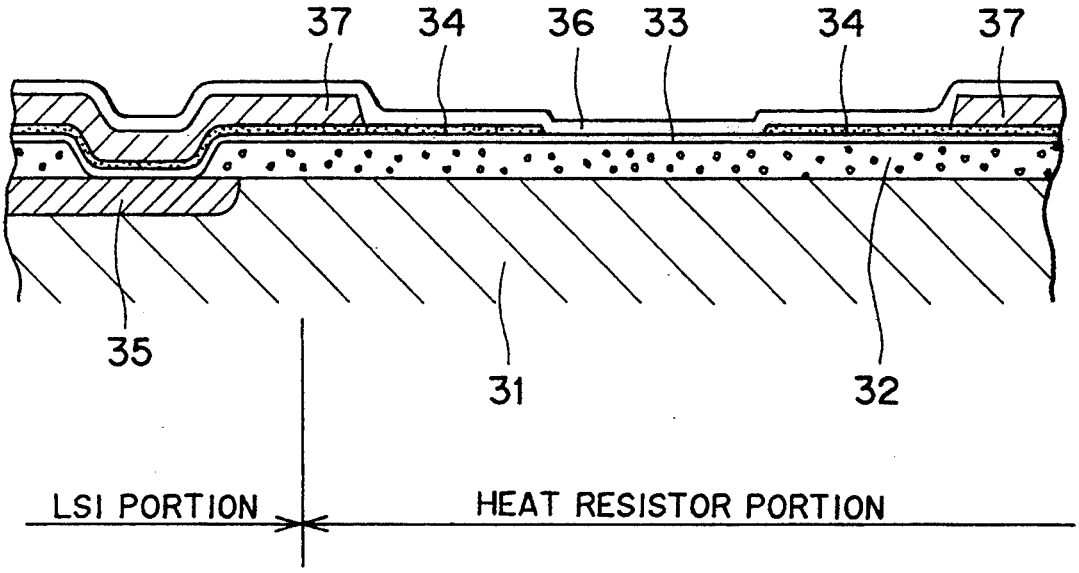
FIG. 7 is a cross-sectional view showing a thermal print head according to a sixth embodiment of the present invention.

As shown in FIG. 7, a thermal recording head according to a sixth preferred embodiment of the present invention has the same construction as that of the fifth except for the addition of an anti-abrasion layer 36 and an additional conductor layer 37. As mentioned previously, hard contaminants such as grit can work their way in between the heat-sensitive paper and the thermal recording head during recording, abrading and damaging the exposed components of the heat resistor such as the thin-film resistor 33 and the conductor 37. In the sixth preferred embodiment these components are covered with an extremely thin anti-abrasion layer 6 (0.1 to 0.5 μm thick $Si_3N_4$ or $Ta_2O_5$ layer) to prevent abrasion without degrading heat efficiency. A layer formed from $Si_2N_4$ produces an especially good anti-abrasion layer 36 because, in addition to being hard and having good heat transmitting characteristics, it can also double as a passivation layer for the semiconductor device (LSI).

In the sixth preferred embodiment, the thin-film conductor 37 is made from a metal such as nickel, molybdenum, tantalum, tungsten, or aluminum. Addition of this layer produces a double-layer thin-film conductor with reduced resistance. When the thin-film conductor 37 is formed from soft metals, such as aluminum, it must be positioned away from where the platen presses the heat-sensitive recording paper against the thermal recording head to avoid deformation of the conductor 37 by pressure.

Figure 8:
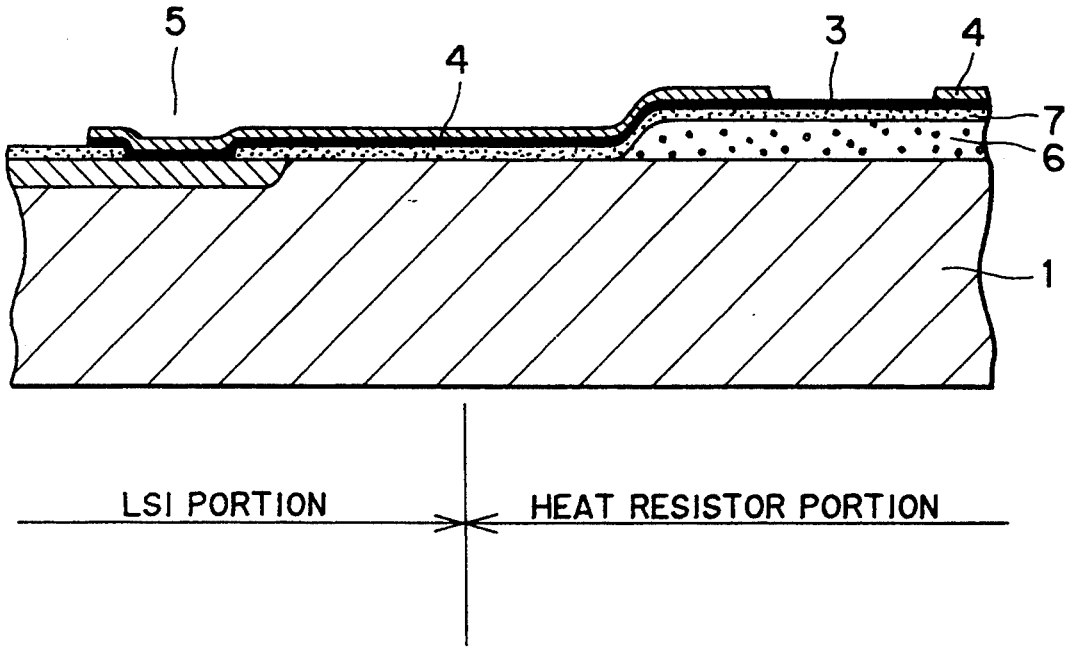
FIG. 8 is a cross-sectional view showing a heat resistor according to seventh embodiment of the present invention.

As shown in FIG. 8, a thermal recording head according to a seventh preferred embodiment of the present invention is similar to a thermal recording head according to the sixth preferred embodiment except for improvement of the thermal insulation layer between the heat resistor layer and the substrate. According to the seventh preferred embodiment, the thermal insulation is a double-layer structure formed from a heat-resistant resin layer 56 and an inorganic insulation layer 57.

In this thermal recording head, a plurality of approximately 2,000 Å thick nickel thin-film conductor 54 (only one of which is shown in FIG., 8) supply current to a plurality of approximately 700 Å thick Cr—Si—SiO alloy thin-film heat resistors 53 (only one of which is shown in FIG., 8) formed at a pitch of 400 dpi. One side of each thin-film conductor 54 is connected via a through-hole in the insulation layer 57 to a terminal 55 of a drive LSI circuit and the other side of each thin-film conductor 54 is connected to a common electrode. In this embodiment, each heat resistor 53 is 50 μm wide and 75 μm long, and has a resistance of about 2,500 Ω.

The following text will further explain the double-layer heat insulation layer.

On a silicon wafer with aluminum wiring is formed a drive LSI using metal oxide semiconductor (MOS) or balanced in plane (BIP) production processes. Aluminum wiring processes can be performed while forming the heat resistor although this process is more difficult because a passivation layer is required. After aluminum wiring processes are complete, an approximately 3 μm thick heat-resistant resin layer 56 is formed from, for example, PIQ-L100 produced by Hitachi Chemical, Co., Ltd. The heat-resistance resin layer 56 is photoetched away except for an approximately 0.5 to 1.0 mm wide section, for the heat resistor 53 shown in FIG. 8, and the areas covering aluminum wiring (not shown). The heat-resistant layer 56 is preserved over the aluminum wiring to prevent their corrosion. Plasma surface processes are performed after sufficient cure at 400° C. Plasma surface processes are performed to insure that the inorganic insulation layer 57 adheres sufficiently to the heat-resistant resin layer 56. The inorganic insulation layer 57 is then formed from an approximately 2 μm thick $SiO_2$ layer using, for example, plasma CVD techniques. The $SiO_2$ layer at the portion of the connector electrodes 55 and the aluminum wiring that connects to external circuits is removed using photoetching. To this is formed a Cr—Si—SiO/Ni thin-film heat resistor as described previously.

The present inventor produced a 400 dpi monolithic LSI circuit thermal recording head with heat resistors according to the seventh preferred embodiment, mounted and connected it to a heatsink, and performed evaluation tests to determine its life by recording on heat-sensitive paper. At application of a 0.5 ms pulse, this thermal recording head required 0.065 W/dot to produce images with a concentration of 1.2 on the heat-sensitive paper. This shows an approximately 35% increase in heat efficiency over a thermal recording head according to the sixth embodiment shown in FIG. 7 which requires 0.10 W/dot to produce the same quality images under the same conditions. No tailing of images was observed at an inter-pulse frequency of 3 to 5 ms, showing that the thermal recording head has good cooling characteristics. The thermal recording head displayed a life of 50 million pulses or more per heat resistor.

Here the differences between conventional thermal recording heads and a thermal recording head according to the seventh embodiment will be explained. For example, Japanese Patent Application Kokai No. SHO-52-100245, Japanese Patent Application Kokai No. SHO-56-164876, and Japanese Patent Application Kokai No. SHO-61-290067 describe a heat resistor formed directly on a heat-insulation resin. The heat resistor is covered with anti-oxidation and anti-abrasion layers 5 to 10 μm thick in total. Because the heat resistor must heat the protective layers in order to heat the heat-sensitive paper, its own temperature must be higher than that of the protective layers. Simulations have shown that the heat resistor can be 200° to 300° C. hotter than the protective layer contacting the heat-sensitive paper. Also, the heat-resistant resin layer is heated to a temperature 200° to 300° C. higher than the heated surface of the heat-sensitive paper.

On the other hand, the heat resistor of the thermal recording head according to the depicted embodiment is in direct contact with the heat-sensitive paper so temperature of the heat resistor does not need to be raised as high. The hottest surface of the heat-resistant resin 56, that is the surface contacting the $SiO_2$ layer 57, receives a temperature 50° to 100° C. lower than that received by the heat-sensitive paper. The temperature of a heat-resistant resin in conventional thermal recording heads exceeds 600° C. However, the temperature of an equally thick heat-resistant layer in a heat resistor according to the depicted embodiment can be estimated to remain around 300° to 350° C. when recording images at the same darkness.

Japanese Patent Application Kokai No. SHO-61-12357 describes a thermal recording head with heat resistors having a second heat-resistant layer provided between a heat-resistant resin layer and the heat resistor. However, this thermal recording head also includes conventional protective layers provided to the heat resistor, so the temperature attained by the heat-resistant resin layer is only reduced from 600° C. to 500° C. Actually this thermal recording head can not be practically applied because the heat-resistant resin can only be used up to temperatures of 350° to 400° C..

Because PIQ-L100, which has good adhesive qualities, can be used as the heat-resistant resin, no particular processing of the substrate surface is necessary. However, other polyimides can be used with equally favorable results. This layer can be between 1 to 5 μm thick depending on the desired recording speed.

The inorganic insulation layer 57 is formed from a $SiO_2$ layer approximately 2 μm thick because at this thickness mechanical strength is optimal and CVD time is sufficiently short. However, this layer could be made thicker. Also, $Si_3N_4$ can be used instead of $SiO_2$. However, a layer of $Si_3N_4$ can be made slightly thinner than a layer of $SiO_2$, for example, 1 to 2 μm, because the breaking strength and heat transmission characteristic of $Si_3N_4$ is higher.

In the depicted embodiment nickel is used for the conductor, but this could be replaced with chromium, molybdenum, tungsten, or tantalum. Chromium is soft so should not be used without a protective layer. The present inventor performed recording tests, where grit was introduced between the heat-sensitive paper and the thermal recording head, and severe reliability tests on this thermal recording head. Because the thermal recording head according to this embodiment uses a comparatively soft resin as the heat-resistant layer, its life tended to be short compared to when a glazed substrate is used. The present inventor produced several more thermal recording heads, each with the heat resistors covered with $Si3N_4$ layers between 0.3 and 1.0 μm thick. Performing tests on these thermal recording heads showed that providing a $Si_3N_4$ layer of 0.5 μm or more thick to the heat resistors sufficiently increases life. The recording efficiency of a thermal recording head with heat resistors having a 1 μm thick $Si_3N_4$ layer showed only a 5 to 10% reduction in efficiency.

Figure 9:
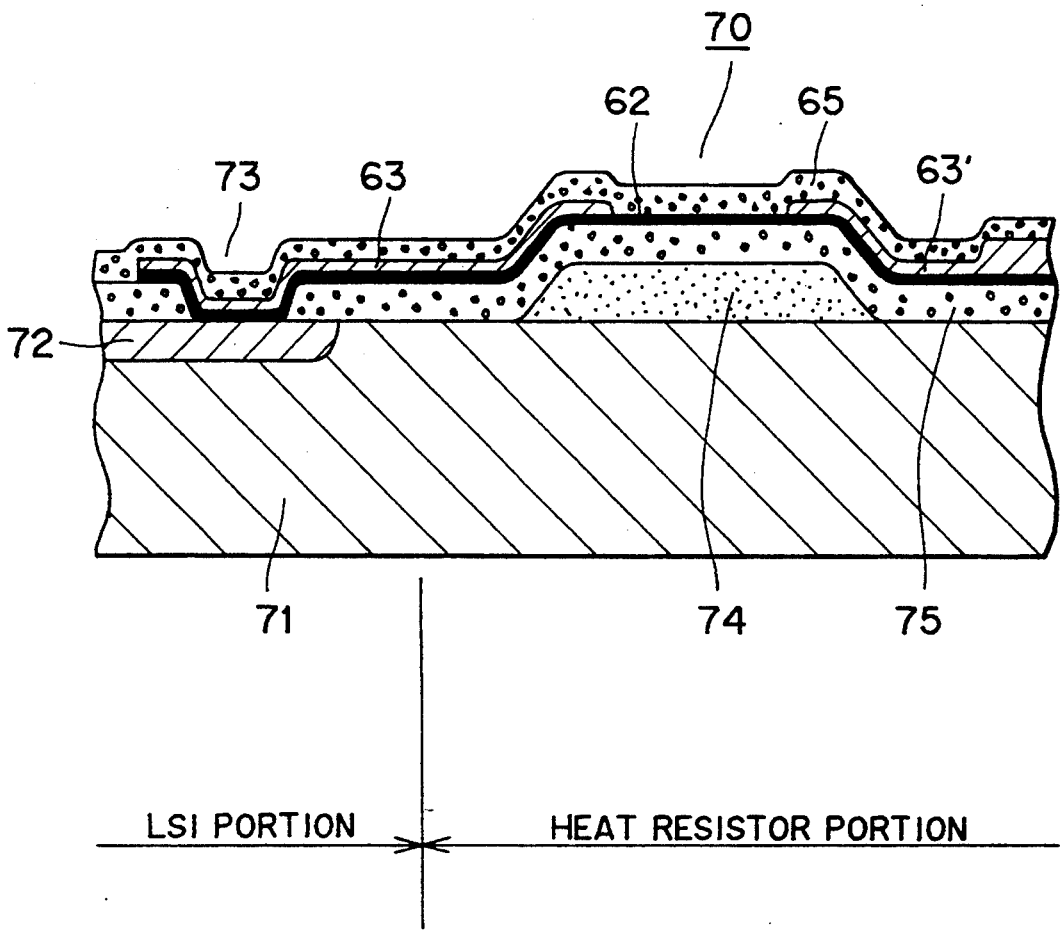
FIG. 9 is a modification of the seventh embodiment shown in FIG. 8.

Next, a thermal recording head according to a eighth preferred embodiment of the present invention will be explained while referring to FIG. 9. This embodiment is a modification of the seventh embodiment shown in FIG. 8. The thermal recording head according to this embodiment is also easier to produce compared to that of the previous embodiment. As shown in FIG. 9, the double-layer structure of the thermal-isolation layer is formed from a thermal-resistance resin layer 74 and an inorganic insulation layer 75 formed on the silicon substrate 71 that includes the drive circuit. The thermal-resistance resin layer 74 has a composite linear thermal expansion coefficient between room temperature and 300° C. of $5\times10^{-6}$°/C. On top of these is formed a heat resistor 70 formed from the Cr—Si—SiO alloy thin-film resistor and the thin-film conductor formed from nickel, chromium, molybdenum, tantalum, or tungsten described in the previous embodiment.

As shown in Table 2, the silicon substrate has a low linear thermal expansion coefficient of $3.1\times10^{-6}$°/C. To the silicon substrate is formed a 2 to 5 μm thick layer of polyimide as is conventionally performed in the semiconductor field. This layer of polyimide forms the heat-resistant resin layer 74. When a 2 to 3 μm thick layer of $SiO_2$ (which has a low linear thermal expansion coefficient) is formed to the heat-resistant resin layer 74 as the inorganic insulation layer 75, generation of cracks can be prevented by using a polyimide with a low linear thermal expansion coefficient, for example such Hitachi Chemical Co., Ltd. products as Polyimide PIQ-L 100 (with linear thermal expansion coefficient of $3\times10^{-6}$°/C.) or PIX-L110 (with linear thermal expansion coefficient of $5\times10^{-6}$°/C.), to form a heat-resistant layer 74.

Generally the heat transmission rate of the polyimide material is about one tenth that of the glass material used as the heat-insulation layer of the thermal recording head. Therefore, in terms of heat transmission rate, the 2 to 5 μm thick polyimide layer is equivalent to a 20 to 50 μm thick glass layer. For example, the 3 μm thick layer of polyimide and the 2 μm thick layer of $SiO_2$ forming the double-layer structure of the heat-insulation layer are equivalent to a glass layer about 30 μm thick. Taking the influence of the silicon substrate into account, the linear thermal expansion coefficient of the heat-insulation layer can be estimated as 2 to $3\times10^{-6}$°/C.

A layer of $Si_3N_4$, which has excellent mechanical strength, can be used instead of $SiO_2$ as the inorganic insulation layer 75. Using a layer of $Si_3N_4$ for the inorganic insulation layer 75 would be particularly effective in environments where dust and dirt often work in between the thermal recording head and the heat-sensitive paper. It also greatly contributes to mechanically strengthening the relatively soft polyimide. The linear thermal expansion coefficient of the heat-insulation layer, formed from a double-layer structure comprising the 3 μm thick layer of polyimide (heat-resistance resin layer 74) and the 2 μm thick layer of $Si_3N_4$ (inorganic insulation layer 75), can be assumed to be the same as the linear thermal expansion coefficient of the $Si_3N_4$ layer only, that is, $3.0\times10^{-6}$°/C. It should be noted that heat-insulation characteristics of the heat-insulation layer 75 are determined by the polyimide layer.

The present inventor produced a monolithic LSI thermal recording head by spin coating a thin 2 to 5 μm polyimide layer to the silicon substrate 71. After allowing a primary hardening of the polyimide layer, it was removed by photo-etching except near the heat resistor and the drive circuit. It was then hardened a final time. This series of processes are the same as those commonly used in semiconductor manufacturing except that stepping of the thin polyimide layer is continuous as performed by automatic processes. That is, by using the thin polyimide heat-insulation layer, stepping processes used to form the thick conventional double-layer structure of the heat-insulation layer can be executed by technologically simple, general semi-conductor processes. It should be noted that a through-hole is formed in the $SiO_2$, or $Si_3N_4$, layer at the position where the drive circuit connects the heat resistor and the wiring conductor.

Figure 10:
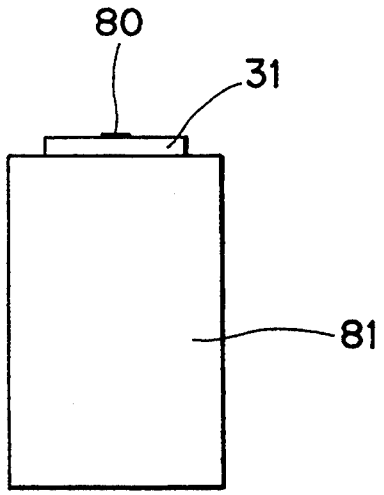
FIG. 10 includes a cross-sectional view and a plan view showing a thermal print head on which is mounded the heat resistor shown in FIG. 5.
Figure 10:
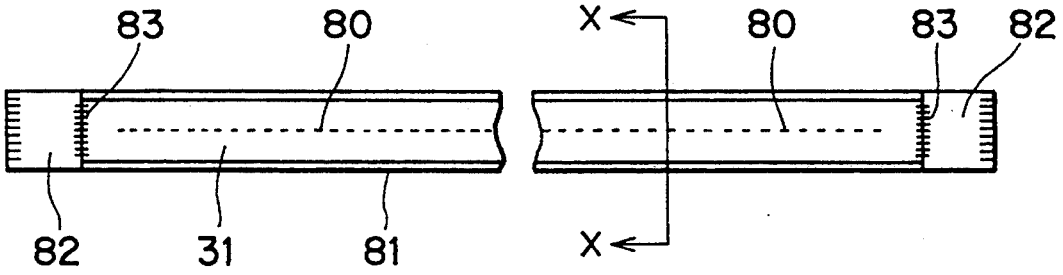

The monolithic LSI thermal recording head was completed by forming a heat resistor 70 on the heat-insulation layer, formed from double-layer structure described above, and connecting it to its respective drive circuit. Although not visible in FIG. 9, the thermal recording head is actually formed from a plurality of heat resistors 70 (formed from a Cr—Si—SiO alloy thin-film resistor and a thin-film conductor formed from nickel, chromium, molybdenum, tantalum or tungsten as described in the previous embodiment) and collector electrodes 72 (of the drive LSI circuit) at a pitch of, for example, 200 dpi in the direction perpendicular to the cross-sectional cut shown in FIG. 9. The plurality of heat resistors 70 are connected at the side opposite the collector electrode 72 by a common nickel thin-film conductor electrode 63'. Seven signal lines are connected to the drive LSI circuit for its control: a driver line, a strobe line, a clock line, and latch line, a power source line, an integrated circuit (IC) power source line, and the above common electrode (ground). These collectively drive all the heat resistors. The monolithic LSI thermal recording head shown in FIG. 9 can be made with a width of less than 3 to 4 mm and mounted as shown in FIG. 10 to be described later. The length of the head, however, is determined by the size of the silicon wafer. Therefore, a thermal recording head only half the length of a A4 or B4 size sheet of paper can be produced from a six inch wafer. Consequently, to form a A4 or B4 size head, two half-length monolithic LSI recording heads placed on the heatsink 81 are connected by die bonding. However, only the seven signal wires at the connector 82 drive the head. An extremely thin thermal recording head only 3 to 4 mm wide can be produced using this simple assembly process. The heatsink 81 is produced from a Fe-42%Ni alloy because this closely has a linear thermal expansion coefficient similar to that of the silicon substrate 31. The heat resistor 80 is mounted by die bonding performed by soldering. A thin protective layer 65 can be provided if necessary.

The present inventor performed step-up stress tests on this thermal recording head by applying a 0.3 ms pulse at inter-pulse interval of 3 ms. The thermal recording head showed an anti-pulse characteristic of 0.28 mJ which is almost the same as that of thermal recording head No. 3 in the sixth and seventh embodiments. Energy required to produce images of the same tone as those produced by a thermal head according to the sixth and seventh embodiments was halved to 0.12 mJ and anti-pulse tolerance was greatly improved to 2.3.

Heat efficiency is improved because the heat resistor is elevated 2 to 5 μm above the surrounding parts, thereby improving its contact with the heat-sensitive paper, because the heat-insulating resin layer 74 is made from a polyimide, which has an extremely low rate of heat transmission, because the $Si_3N_4$ layer, which is used for the protective layer for protecting against scratching caused by introduction of grit between the heat resistor and the heat-sensitive paper, has a high rate of heat transmission, because the $Si_3N_4$protective layer is less than 1 μm thick, and because heat can be more efficiently used when the width of the recording pulse is shortened. In addition, no tailing is observed despite shortening the inter-pulse interval to 2 to 3 ms because the thermal-isolation layer is made from a small double-layer structure formed from a heat-resistant resin layer and an inorganic insulation layer, and because of the silicon substrate, which has a high rate of heat transmission.

The present inventor confirmed that when the inter-pulse interval is further shortened to 1 to 2 ms, the thickness of the heat-resistant resin layer 74 of the double-layer structure of the thermal insulation layer can be further reduced to about 2 μm.

The present inventor performed actual recording tests by applying a 0.12 mJ/dot pulse at width of 0.3 ms and inter-pulse interval of 3 ms to the thermal recording head according to the eighth embodiment to determine its life. The thermal recording head successfully generated 100 million or more pulses per heat resistor. The present inventor also performed actual recording tests by applying a 0.11 mJ/dot pulse at width of 0.1 ms and an inter-pulse interval of 2 ms the results being that the resistance of the heat resistors increased 10% or more at 20 to 30 million pulses. The reason recording with this short pulse width produces this life characteristic is compared to heat resistors which have thick conventional protective layers, the heat resistor according to the present invention reaches a temperature about 200° to 300° C. lower as shown by the results of simulation the same tone concentration. Also, the 2 to 3 μm thick inorganic insulation layer 75 between the Cr—Si—SiO alloy thin-film resistor 62 and heat-resistant resin layer 74 lowers the temperature received by the polyimide 50° to 100° C. However, when the total thickness of the inorganic insulation layer 75 and the protective layer 65 becomes less than 1 to 2 μm, pressure from the platen roller can cause fatigue deformation in the polyimide that result in severing of the heat resistor. Consequently, the total thickness of the inorganic insulation layer 75 and the protective layer 65 must be over 2 μm with mechanically strong $Si_3N_4$ as the protective layer. Thinking in terms of productivity, a total thickness in the range of 2 to 4 μm is optimal.

Even if a drive circuit is produced by way of semiconductor manufacturing process with a rule of 2 to 3 μm, the territory of the device could fall within a range of from 300 to 500 μm width. Because heat efficiency has been improved about three times, the flow of heat to the silicon substrate is ⅓ that of conventional heads. The pitch required between the heat resistors to prevent the temperature of the device from exceeding 100° C. was proven in simulations to be at most 200 μm. Production processes for producing 10 μm rule can be used even for a 600 dpi heat resistor. In both cases, it is possible to produce a thermal recording head using a process with an extremely good yield. This high-yield process brings production costs of a high value-added monolithic LSI thermal recording head to the level of an average conventional thermal recording head. A thermal head with length of a five or six inch wafer can be produced with dot density of 1,000 dpi, and at about the same costs. However, a A4 or B4 size thermal recording head can be produced by joining two wafers. With this method the dot density is limited to 400 dpi. Several thousand wire bonding processes are required to produce a conventional thermal recording head which uses a glazed ceramic substrate. Additionally, the dot density of the line head is limited to 200 to 300 dpi. In contrast to this, only about 20 wire bonding operations are required in a thermal recording head according to the present invention. In addition, the thermal recording head can be made one tenth or one twentieth narrower than a conventional thermal recording head. The heat efficiency is about three times higher (from 0.34 mJ to 0.12 mJ), the recording speed is several times faster, and continuous feed of the recording paper is possible. These factors contribute to reducing the size, reducing the energy As described above, Ta—Si—SiO alloy thin-film resistor material has many properties similar to the Cr—Si—SiO alloy thin-film resistor material described in the previous embodiments. The present inventor produced a thermal head including heat resistors made from Ta—Si—SiO alloy thin-film resistor material and performed the same evaluation tests. The results of these test showed that the only difference between these two materials is that although the Cr—Si—SiO alloy thin-film resistor severed after the rate of resistance change values dropped and then rose during the step-up stress test (see FIG. 11 and the life tests (see FIG. 13), the Ta—Si—SiO alloy thin-film resistor severed after the rate of resistance change values slowly but continuously increased (with no drop). Consequently, a protection-layerless Ta—Si—SiO alloy thin-film resistor also can be used to produce a thermal recording head for high speed recording if the linear thermal expansion coefficient of the substrate is $5\times10^{-6}$°/C. or less. A monolithic LSI thermal recording head as described in the seventh and eight preferred embodiments can be produced according to the ninth embodiment.

The present inventor incorporated, as shown in FIG. 10, the above described heat resistor and LSI drive circuit mounted on the silicon substrate 31 into a 200 dot per inch (DPI) thermal recording head. The approximately 3 mm wide silicon substrate 31 was first die bonded onto an approximately 4 mm wide heatsink 81. The silicon substrate 31 was then electrically connected to a connector 82 attached to the heatsink 31. The silicon substrate 31 was connected to the connector 82. It should be noted that these can be connected by one wire bonding process, which uses gold wire 83, or one tape carrier method so that the number of connections equals the number of control signal lines or power source lines. In this way, a thin, compact thermal recording head can be produced.

The thermal recording head thus constructed produces a protection-layerless Cr—Si—SiO alloy thin-film heat resistor formed on a substrate with low thermal expansion coefficient. In this embodiment, the conventional 50 to 100 μm thick thermal-isolation layer, considered indispensable up to now, is reduced to only 8 μm thick. This is made possible by the extremely short 0.1 to 0.3 ms pulse, described in the proceeding embodiment, and the reduction in heat flow to the thermal-isolation layer resulting from elimination of protective layers. Even a $SiO_2$ layer formed as thin as allowed by the silicon substrate can be used as the heat resistant layer.

The present inventor performed continuous mock recording tests on this thermal recording head by applying 0.25 mJ/dot pulses at width of 0.3 ms and inter-pulse interval of 3 ms. The thermal recording head functioned reliably for 50 million pulses or more per heat resistor. The present inventor also performed continuous mock recording tests on this thermal recording head by applying 0.22 mJ/dot pulses at width of 0.1 ms and inter-pulse interval of 1 ms. In this case also the thermal recording head functioned reliably for 50 million pulses or more per heat resistor. Even at this extremely rapid recording speed no tailing could be observed. A silicon substrate with excellent heat transmission capabilities and a thin thermal-insulation layer combine to produce suitable thermal isolation and rapid cooling characteristics.

Although the present invention has been described with respect to specific embodiments, it will be appreciated by one skilled in the art that a variety of changes and modifications may be made without departing from the scope of the invention. For example, certain features may be used independently of others and equivalents may be substituted all within the spirit and scope of the invention.

What is claimed is:

1. A thermal recording head for a printer for thermally recording characters on a heat-sensitive recording medium, comprising:

a heatsink with a connector attached thereto, the connector containing a plurality of signal lines;

a substrate provided on the heatsink;

driving means provided on the substrate, the driving means being connected to the connector by one connection for each of the plurality of signal lines, the driving means generating a pulsed electric current and outputting the pulsed electric current at a collector electrode;

a heat-resistant resin layer provided on the substrate a distance from the collector electrode, the heat-resistant resin layer having a surface facing opposite the substrate defining an elevated area:

an inorganic thermal insulation layer made from a material with a linear thermal expansion coefficient of less than $5\times10^{-6}$°/C. from 20° to 300 ° C., the inorganic thermal insulation layer covering at least the elevated area of the heat-resistant resin layer and the distance to the collector electrode, a combined thickness of the heat-resistant resin layer and the inorganic thermal insulation layer being thicker at the elevated area than at the collector electrode;

a thin-film resistor layer provided to the inorganic insulation layer, the thin-film resistor layer being a thin-film layer that is 500 to 1,000 Å thick and made from a material selected from a group consisting of a Cr—Si—SiO alloy and a Ta—Si—SiO alloy, the thin-film resistor layer having a heating portion substantially at the elevated area, the thin-film resistor layer being in direct contact with the collector electrode, the thin-film resistor layer being energized by the pulsed electric current, the heating portion heating in pulses according to the pulsed electric current;

a first conductor layer provided to the thin-film resistor layer except at the heating portion, the first conductor layer serving as a conductor for supplying the pulsed electric current to the thin-film resistor layer; and an anti-abrasion layer provided 1 μm or less thick to the heating portion for forming direct abutment contact with the heat-sensitive recording medium and transmitting the pulsed heat from the heating portion thereto for forming an image thereon.

2. The thermal head as claimed in claim 1, wherein the heatsink is 4 mm wide and made from a Fe-42% Ni alloy.

* * * * *